US005739791A

United States Patent [19]

Barefield et al.

[11] Patent Number: 5,739,791

[45] Date of Patent: Apr. 14, 1998

[54] ANTENNA FOR USE WITH A RADIO INSTALLED IN AN EXPANSION SLOT OF A COMPUTER SYSTEM

[75] Inventors: Jonathan D. Barefield, Alpharetta; Hosea D. Dorris, Norcross; Emory P. Long, Lawrenceville, all of Ga.

[73] Assignee: LXE Inc., Norcross, Ga.

[21] Appl. No.: 554,085

[22] Filed: Nov. 6, 1995

[51] Int. Cl.[6] ..... H01Q 1/24

[52] U.S. Cl. ..... 343/702; 343/795

[58] Field of Search ..... 343/702, 700 MS, 343/795, 872; 455/89, 90; H01Q 1/24

[56] References Cited

U.S. PATENT DOCUMENTS

| | | | |
|---|---|---|---|
| 5,043,721 | 8/1991 | May | 340/825.44 |
| 5,293,400 | 3/1994 | Monod et al. | 375/7 |
| 5,307,297 | 4/1994 | Iguchi et al. | 364/708.1 |
| 5,335,276 | 8/1994 | Thompson et al. | 380/21 |
| 5,345,231 | 9/1994 | Koo et al. | 340/870.31 |
| 5,361,061 | 11/1994 | Mays et al. | 343/702 |
| 5,404,583 | 4/1995 | Lalezari et al. | 455/90 |
| 5,418,524 | 5/1995 | Fennell | 340/825.22 |
| 5,436,621 | 7/1995 | Macko et al. | 340/825.44 |
| 5,437,057 | 7/1995 | Richley et al. | 455/41 |
| 5,495,260 | 2/1996 | Couture | 343/702 |
| 5,557,288 | 9/1996 | Kato et al. | 343/702 |

FOREIGN PATENT DOCUMENTS

| | | | |
|---|---|---|---|
| 24722 | 10/1994 | WIPO | H01Q 1/24 |

*Primary Examiner*—Hoanganh T. Le
*Attorney, Agent, or Firm*—Jones & Askew, LLP

[57] ABSTRACT

An antenna that may be retrofitted for incorporation in an internal compartment of a computer terminal when a radio transmitter or receiver is installed in an expansion slot of the computer terminal. The present invention provides a radio receiver/transmitter communication system for a computer terminal. The computer terminal includes an expansion slot operative to receive a radio transmitter or receiver and includes an enclosed compartment defined in the housing of the computer terminal. The enclosed compartment is separate from the expansion slot. The radio receiver/transmitter communication system includes a printed circuit board and a radio frequency communication medium. The radio frequency communication medium is etched on a first side of the printed circuit board, thereby forming a circuit board antenna, and the printed circuit board antenna is positioned within the enclosed compartment of the computer terminal. The radio communication system also includes a radio transmitter/receiver expansion board installed in the expansion slot and a connection cable connected to and providing a transmission path between the radio frequency communication medium of the circuit board antenna and the radio transmitter/receiver. The radio communication system is preferably implemented in a portable computer terminal that includes a the stylus pen slot as an internal compartment.

18 Claims, 4 Drawing Sheets

ANTENNA FOR USE WITH A RADIO INSTALLED IN AN EXPANSION SLOT OF A COMPUTER SYSTEM

FIELD OF THE INVENTION

The present invention generally relates to an antenna added to a radio transmitter or receiver of a computer system and, more particularly, to an antenna that is used with a portable computer terminal that has a radio installed in an expansion slot of the computer system.

BACKGROUND OF THE INVENTION

With the advent of handheld or portable computing devices, such as a portable computer terminal, remote data collection and computer transactions may be handled conveniently. After an operator or user of a portable computer terminal collects the data or processes or inputs information from a remote location, the user often transfers the information to a central computing system. The transfer of information may occur by connecting a serial port of the portable computer terminal to a serial port of the central computing system. However, communicating information to a central computing system from a portable device may be more conveniently accomplished via wireless communication.

For computer terminals that do not include radio transmitters or receivers in the original design, radio transmitters or receivers may be installed in expansion slots of the computer terminal. Many portable computer terminals include expansion slots for receiving circuit boards that provide additional operation capabilities for the computer terminals. For example, a particular type expansion slot available on many personal computers is a Personal Computer Memory Card International Association (PCMCIA) expansion slot. In portable computing devices, PCMCIA slots for accepting circuit boards that perform the functions of a radio transmitter/receiver may be used to provide wireless communication between the portable computing device and the central computing system or other computing system. With the use of PCMCIA based wireless communication, the prior art has provided an antenna that protrudes from the portable device to transmit radio signals to and from the portable terminal.

Because a portable computer terminal or device may be easily transported, the portable computer terminal may be used in a variety of environments, such as in a warehouse or factory, to document or survey inventory. A user may walk throughout the aisles of a warehouse or factory and document the inventory in the portable computer terminal without concern for carrying and keeping track of a lot of paper. Also, the user is not limited to a small area by an electrical extension cord connected to the terminal. The portability of the computer terminal also enables the computer terminal to be used in outdoor environments. For example, telephone company or utility workers may remotely collect data then return the data to a central processing system later for evaluation. Thus, a portable computer terminal may be utilized for many types of operations and may be carried to various remote environments or locations. However, the frequent transportation of the remote computer terminal and its use in a variety of environments makes the computer terminal's external components susceptible to damage.

Because of the frequent transportation of a portable computer terminal, a protruding antenna as taught by the prior art, used with a radio transmitter or receiver which is installed in an expansion slot, is susceptible to damage.

Damage to the antenna of a portable computer terminal can reduce the effectiveness or efficiency of a user of the terminal in communicating data with other computing systems.

Thus, there is a need in the art for an antenna that is not readily susceptible to damage due to rugged handling or tampering and which may be retrofitted for a portable computer terminal.

SUMMARY OF THE INVENTION

Generally described, the present invention provides an antenna that may be retrofitted for incorporation in an internal compartment of a computer terminal when a radio transmitter or receiver is installed in an expansion slot of the computer terminal.

More particularly, the present invention provides a radio receiver/transmitter communication system for a computer terminal. The computer terminal includes an expansion slot operative to receive a radio transmitter or receiver and includes an internal compartment defined in the housing of the computer terminal. The internal compartment is separate from the expansion slot. The radio receiver/transmitter communication system includes a printed circuit board and a radio frequency communication medium. The radio frequency communication medium is etched on a first side of the printed circuit board, thereby forming a circuit board antenna, and the printed circuit board antenna is positioned within the internal compartment of the computer terminal. The radio communication system also includes a radio transmitter/receiver expansion board installed in the expansion slot and a connection cable connected to and providing a transmission path between the radio frequency communication medium of the circuit board antenna and the radio transmitter/receiver.

The radio communication system is preferably implemented in a portable computer terminal that includes a stylus pen slot. The stylus pen slot is the preferred compartment for enclosing the circuit board antenna. It is also preferred that the radio frequency communication medium is the only etched medium on the printed circuit board. The radio frequency communication medium may be etched on a first selected portion of the circuit board and the radio frequency communication medium may also be etched on a second selected portion of the circuit board. The second selected portion may be positioned in contact with a metalized plating of computer terminal housing to ground the antenna circuit. The first selected portion preferably is not in contact with the computer terminal housing.

The circuit board antenna may include a cable connector positioned on the side of the printed circuit board opposite the first side. The cable connector includes conducting extensions which extend through the printed circuit board to the first side of the printed circuit board and the conducting extensions contact the radio frequency communication medium to provide a connection path for radio frequency signals.

As noted in the radio communication system discussed above, the present invention provides a stand-alone printed circuit board antenna for retrofitting in a computer terminal. The stand-alone printed circuit board antenna includes a printed circuit board operative for internal installation within the computer terminal housing and a radio frequency communication medium etched on a first side of the printed circuit board.

Thus, it is an object of the present invention to provide an antenna for internal mounting in a computer terminal that has a radio transmitter or receiver installed in an expansion slot.

It is another object of the present invention to provide an antenna that may be installed internally in an existing compartment of a computer terminal.

It is another object of the present invention to provide a retrofitted antenna for a computer terminal that is protected from damage that may occur due to rugged handling.

It is another object of the present invention to provide an antenna that may be internally installed in a computer terminal without modification to the computer terminal housing.

These and other objects, features, and advantages of the present invention will become apparent from reading the following description in conjunction with the accompanying drawings.

DETAILED DESCRIPTION

Figure 1:
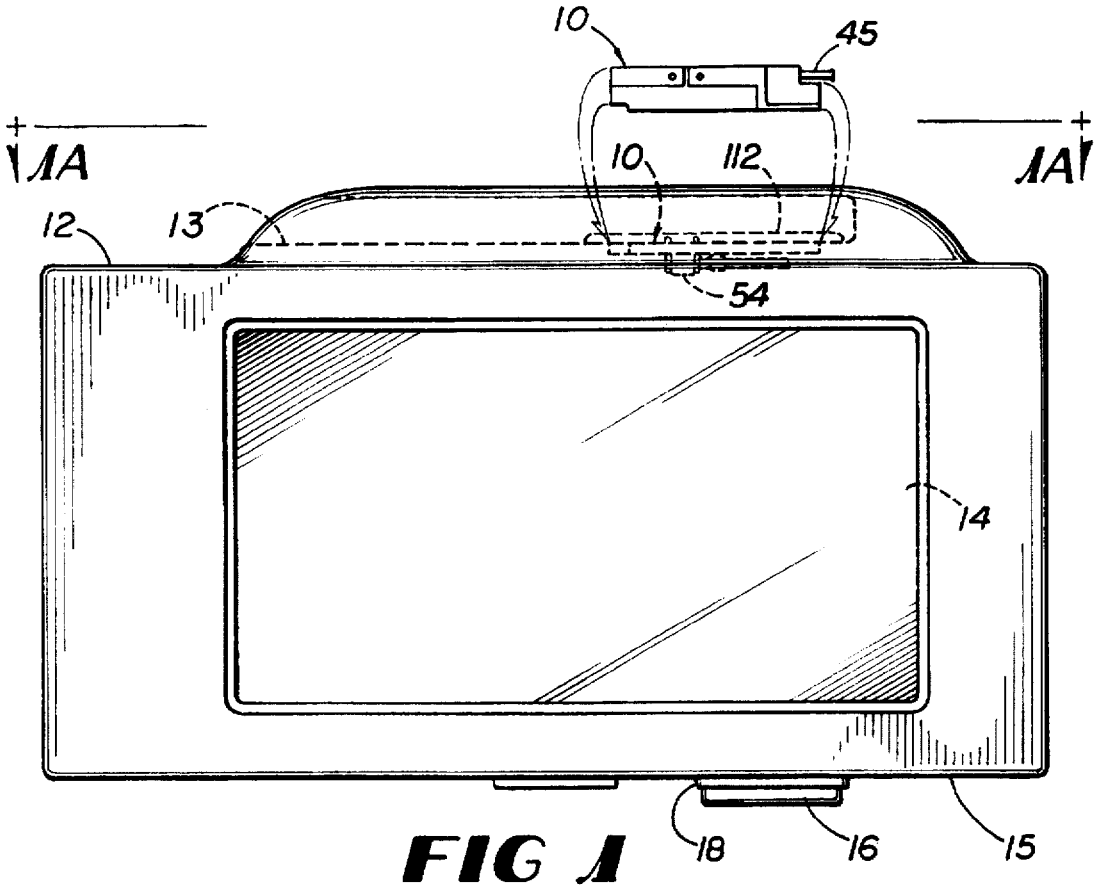
FIG. 1 is an exploded view of a circuit board antenna of the present invention as incorporated in a portable computer terminal.
Figure 1A:
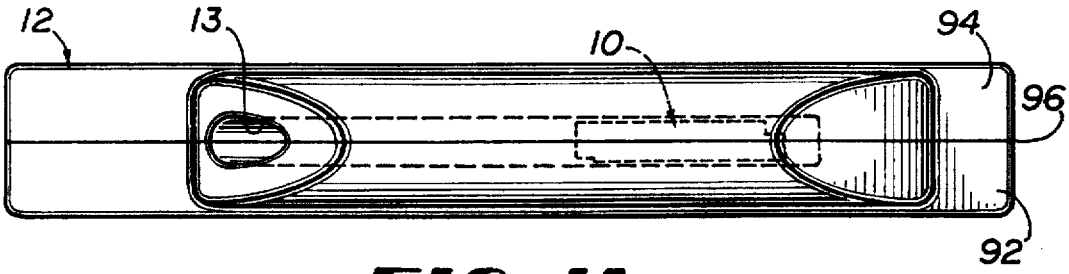
FIG. 1A is a view of the portable computer terminal taken along line 1A—1A of FIG. 1.
Figure 1B:
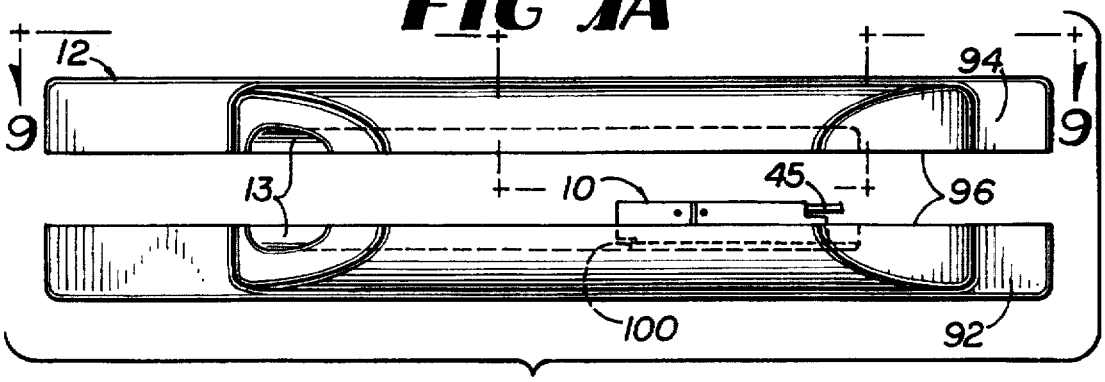
FIG. 1B shows the housing of the portable computer terminal separated into two sections.

Referring to FIG. 1, a circuit board antenna 10 of the present invention is shown incorporated within a portable computer terminal 12. The present invention provides a circuit board antenna 10 that may be retrofitted for incorporation in the housing 15 of the portable computer terminal 12. Referring to FIG. 1A, a view of the portable computer terminal 12 taken along line 1A—1A is shown. The circuit board antenna 10 is internally enclosed and mounted in the pen slot 13 and protected from damage due to improper handling or tampering. As shown in FIG. 1A, the portable computer terminal 12 comprises a first housing section 92 and a second housing section 94 which are connected at a seam 96. The portable computer terminal 12 may be separated, as known by those skilled in the art, at the seam 96 and the circuit board antenna 10 may be inserted or removed from the pen slot 13. The circuit board antenna 10 is firmly secured in pen slot 13 to prevent the circuit board antenna 10 from becoming dislodged. Referring to FIG. 1B, the portable computer terminal 12 is shown separated into its separate housing sections 92 and 94. When the portable computer terminal 12 is separated as illustrated in FIG. 1B, the circuit board antenna 10 may be accessed as shown. The housing section 92 includes a metalized plating 100 that may be used as an electrical grounding mechanism for the circuit board antenna 10.

The computer terminal housing should generally be some form of plastic that is sufficiently rf-transparent in the area immediately surrounding the compartment pen slot 13, which contains the circuit board antenna 10 a to permit reasonable propagation of radio frequency waves. The majority of both housing sections 92 and 94 are metalized on the inside to reduce unintentional radiation or susceptibility at any frequency including rf. The location of the antenna within the computer terminal housing should be determined by such factors as available space, desired radiation characteristics, absence of nearby metalized plating, and proximity to the radio. In general, the antenna may be any number of possible configurations including dipole, monopole, slotted, etc., depending on the desired polarization and radiation pattern. The portable computer terminal 15 is preferably a Fujitsu model stylistic 500 (ST-500) pen-based personal computer.

With a pen-based computer, the user of the portable computer terminal 12 inputs commands by using a stylus pen to electronically provide or select commands that are displayed on a display screen of the portable computer terminal 12. Computer systems that use a pen or stylus as a user input device are being used more widely today. Some of the new pen-based computers are small, handheld devices with a display screen but no keyboard. Some of these devices are called "Personal Digital Assistants", "PDAs", or "portable pen pads". With such devices, a user interacts with a display screen like a sheet of paper, using an ink-less pen or stylus to draw pictures, to enter text via handwriting or printing, and to interact with the computer system. The computer interprets the motion of the pen or stylus relative to the display screen, and often displays lines or markings on the screen that track the movement of the pen.

The pen or stylus in a pen-based computing system may be considered a "direct pointing device", that is, a pointing device consisting of a display and an indicator such as a finger, stylus, or other object. The pointing-device actions of "pointing" and "tapping"—which are analogous to "clicking" with a mouse—are achieved by moving the indicator on or near the display screen and touching the display screen, respectively. Pen-based computers offer the advantage of greater portability since no keyboards or pointing devices are required other than a simple stylus.

Because many new generation portable computer terminals use a stylus pen for input control, an area for storing the stylus pen on or in a computer terminal is generally provided. The area used for storing the stylus pen may be termed a pen slot, such as pen slot 13. The pen slot 13 is designed as a vacant compartment for receiving and storing a stylus pen when the stylus pen is not being used by a user.

As noted above, the portable computer terminal 12 may be particularly used in remote locations to collect or input data which may be later downloaded or transferred to a central computer system. The portable computer terminal 12 may be used in a warehouse to document or survey inventory. A user may walk throughout the aisles of a warehouse and document the inventory in the portable computer terminal 12 without concern for carrying and keeping track of a lot of paper or being limited by an electrical extension cord connected to the terminal. The portable computer terminal 12 is also useful in many remote data collection operations. For example, telephone or utility workers may collect data remotely, then return the data to a central processing system later for evaluation. Thus, a portable computer terminal 12 may be utilized for many types of operations and may be carried to various remote environments or locations.

After a remote operator or user of the portable computer terminal 12 collects the data or processes or inputs information from a remote location, the user must then transfer the information to a central data collection processing unit. The transfer of information may occur by connecting a serial port of the portable computer terminal to a serial port of the central data collecting processing unit. Preferably, the transfer of such information to a central processing unit may be completed by radio communication. For computer terminals, such as computer terminal 12, that do not include radio transmitters or receivers in the original design, radio transmitters or receivers may be optionally installed.

Portable computer terminals such as portable computer terminal 12 include expansion slots for receiving circuit boards that provide additional operation capabilities for the computer terminals. As noted above, a particular type expansion slot available on many personal computers is a Personal Computer Memory Card International Association (PCMCIA) expansion slot. A radio transmitter or receiver 16 may be inserted in an expansion slot such as a PCMCIA slot 18 of the portable computer terminal 12. With a radio transmitter or receiver 16, data may be transmitted to and received at the portable computer terminal 12 as commanded by a user. The radio transmitter/receiver 16 may receive and transmit radio frequency signals as readily known by those skilled in the art.

Figure 2:
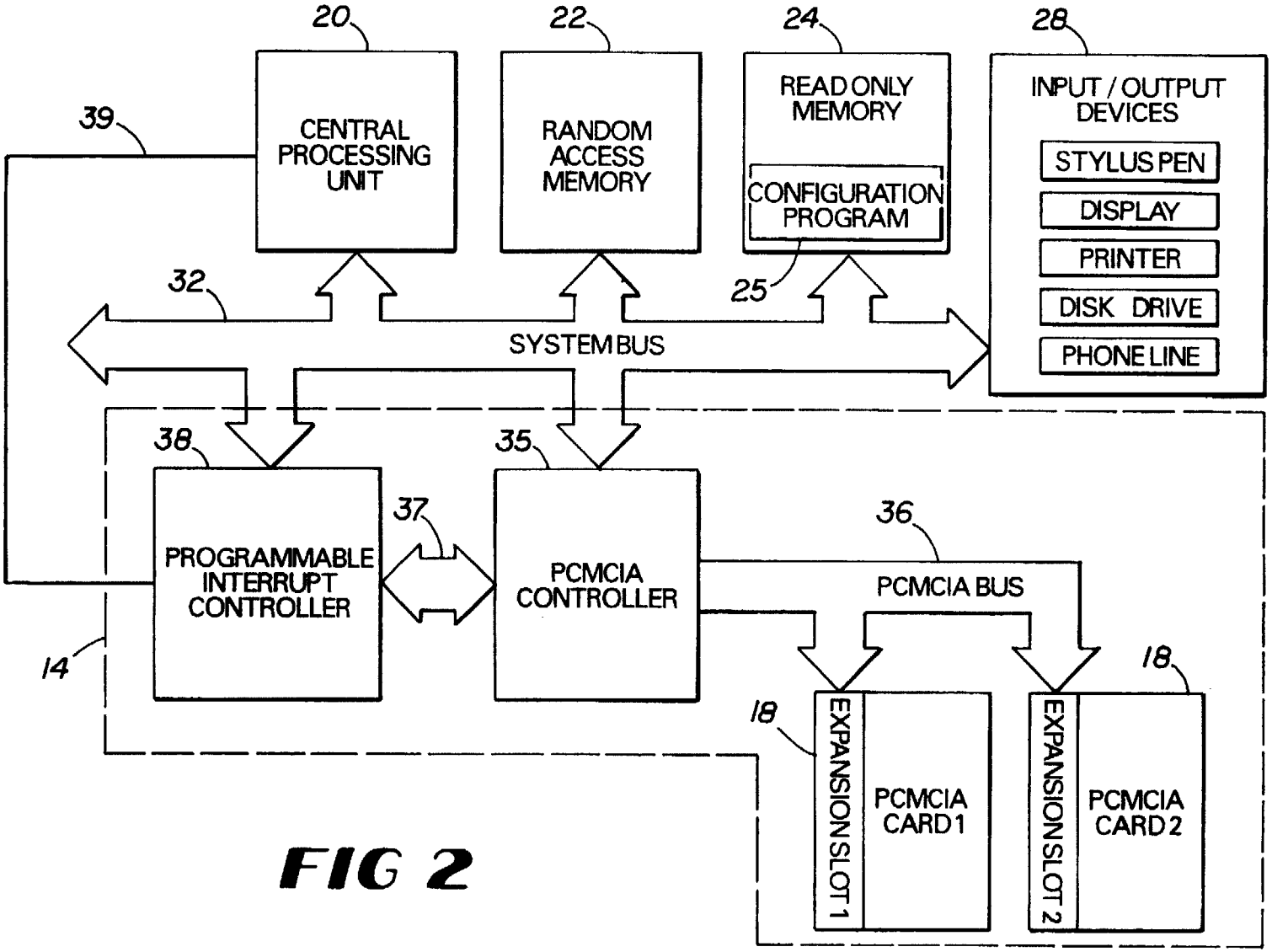
FIG. 2 shows the basic components of the circuitry of the computer system of the computer terminal of FIG. 1.

Referring to FIG. 2, a computer system designed to operate with PCMCIA expansion cards is shown. With the preceding background in mind, the basic components of a computer terminal 12 will be discussed in connection with FIG. 2. PCMCIA control circuitry 14 is connected to a central processing unit (CPU) 20; a random access memory (RAM) 22; a read-only memory (ROM) unit 24 containing a configuration program 25; and input\output (I\O) devices 28 through a system bus 32. The CPU 20 is typically implemented as a single-chip microprocessor, such as the models 80386 or 80486 that are available from Intel Corporation, Santa Clara, Calif. The CPU 20 operates in combination with computer software, such as an operating system and application programs, to control the operations of the computer system. The system bus 32 supports communications of control, address, and data signals between the CPU 20 and the remaining components of the computer system. The RAM 22 is a dynamic or volatile memory module used for temporary storage of data. The ROM unit 24 is useful for storing device-related information that supports the configuration of the devices within the computer system 12.

The PCMCIA circuitry 14 controls the interactions of a PCMCIA card 1, such as radio transmitter/receiver 16, and a PCMCIA card 2 with the components of the computer system. The PCMCIA cards 1 and 2 are electrically connected to the computer system 12 through an expansion slot 1 and an expansion slot 2, respectively. It should be appreciated by those skilled in the art that one or more PCMCIA cards and expansion slots may be provided in a general purpose computer system.

Expansion slots 1 and 2 are connected to a PCMCIA controller 35 via a PCMCIA bus. A Programmable Interrupt Controller (PIC) 38 is connected to the PCMCIA controller 35 via connection bus 37 and provides control for interrupt requests generated by the PCMCIA cards 1 and 2. The PIC 38 has an interrupt line 39 connected to the CPU 20. The interrupt line 39 transmits electrical signals to the CPU 20 that indicate that a peripheral device, such as radio transmitter/receiver 16, is ready to transmit or receive data.

Figure 3:
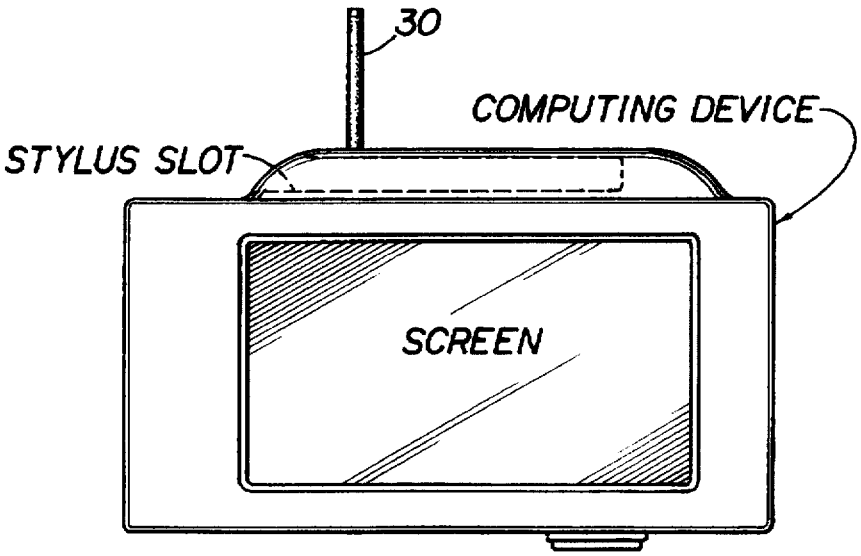
PRIOR ART FIG 3
FIG. 3 shows a prior art antenna used with a portable computer terminal.

As noted above, with the advent of PCMCIA expansion slots and cards, the portable computer terminal 12, which does not have a radio transmitter/receiver installed as part of the originally manufactured design, is provided with an expansion slot in which a radio transmitter/receiver 16 may be installed for transmitting and receiving radio frequency signals. As noted above, with a portable computer terminal 12 the computer terminal is handled and moved about more frequently than if the computer terminal were stationary. The frequent handling or moving of a portable computer 12 generally makes the portable computer terminal 12 more susceptible to damage due to mishandling. With a radio transmitter/receiver 16 installed in an expansion slot 18, an antenna is provided in order to facilitate the wireless transfer or communication of information to and from the portable computer terminal 12 via radio frequency (rf) signals. However, as discussed above, when a radio transmitter/receiver 16 is added to a computer terminal 12, a conventional protruding or exterior antenna is provided. Conventionally, the external antenna provided or implemented with a radio added in an expansion slot protrudes from the casing of the portable computer terminal 12 as illustrated in FIG. 3.

As noted above, due to the portability of the computer terminal 12, the protruding or external antenna 30 becomes very susceptible to damage and, if damaged or broken, inhibits or hinders the transfer or receipt of information at the portable computer terminal 12. Damage to the antenna of the portable computer terminal 12 can reduce the effectiveness or efficiency of a user of the terminal in communicating data with other computing systems.

Thus, when a radio receiver/transmitter is installed or added to a portable computer terminal 12, the present invention provides an antenna which may be installed internally in a vacant cavity of the computer terminal housing without modification to the housing. Because the antenna of the present invention is designed for internal use, the antenna is protected from physical damage due to the rugged handling or tampering. The antenna of the present invention may be mounted in a manner that does not affect the aesthetics of the terminal and does not require modifications of the housing of the portable computer terminal 12.

Figure 4:
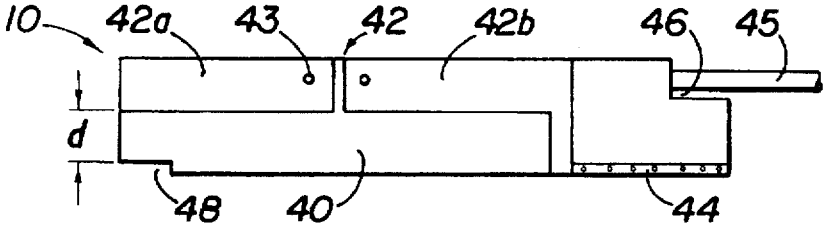
FIG. 4 shows a front view of the circuit board antenna of the present invention.
Figure 5:
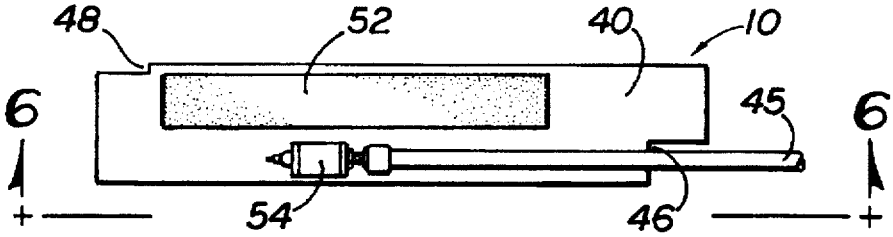
FIG. 5 shows a view of the opposite side of the circuit board antenna illustrated in FIG. 4.
Figure 6:
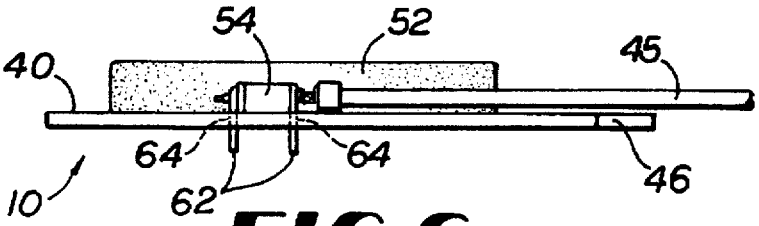
FIG. 6 shows a view of the circuit board antenna taken along line 6—6 of FIG. 5.

Referring to FIGS. 4, 5, and 6, the detail of the circuit board antenna 10 of the present invention is shown. The circuit board antenna 10 is a dipole antenna which supports a 2.4 Ghz spread spectrum radio. The circuit board antenna 10 consists of a printed circuit board 40 that has the radio frequency communication medium or antenna 42 etched thereon. The circuit board 40 is preferably made of FR-4 fiberglass and the metal or radio frequency communication medium is made of one-half ounce copper with tin lead flowed onto the copper. The antenna 42 consists of a positive side 42A and a negative side 42B. The negative side 42B of the antenna 42 also includes a ground extension 44 for grounding the antenna to insure a consistent transmission signal. The printed circuit board is preferably a stand-alone circuit board which does not have non-antenna related circuitry constructed thereon. The printed circuit board 40 has a notch 46 and a notch 48 cut therein to enable the circuit board antenna 10 to fit within the pen slot 13 of the portable computer terminal 12. The notches 46 and 48 are specifically designed to fit within the stylus pen slot of the Fujitsu model ST-500 pen-based personal computer system. It should be appreciated by those skilled in the art that the size of the notches 46 and 48 as well as the dimensions of the printed circuit board 40 may vary according to the size of the vacant cavity in which the circuit board antenna 10 is to be installed and may vary with respect to the desired radio frequency of operation.

The distance d that the antenna 42 is raised on the printed circuit board 40 is utilized to insure that the antenna 42 is not in direct contact with the casing or housing of the portable computer terminal 12. It should be appreciated by those skilled in the art that when the antenna 42 is installed within a vacant compartment such as pen slot 13 that the etched antenna 42 should be positioned on the circuit board 49 so that the antenna 42 does not directly contact any other part of the housing of the portable computer terminal 12. However, it should be noted that the ground portion 44 is extended along the bottom edge of the printed circuit board 40 to insure a good or firm contact with the selected metalized plating 100 of computer terminal housing to provide for stable grounding of the system. The circuit board antenna 10 is connected to a data transmission cable 45 at antenna connection points 43 via a cable connector as discussed below. The data transmission cable 45 is preferably coaxial cable and provides an electrical connection between the antenna 42 and the rf connector of the radio receiver/transmitter 16.

Referring to FIG. 5, the backside of the circuit board antenna 10 is shown. The backside of the circuit board 40 includes an insert such as an adhesive (tape) foam 52 connected to the printed circuit board 40 to provide a secure fit within a vacant slot such as pen slot 13 of the portable computer terminal 12. Other supporting or securing mechanisms, as known to those skilled in the art, may be used instead of the adhesive foam 52. The adhesive foam 52 should be sized or selected to press against the walls or sides of a slot within the portable computer terminal 12 in a manner that provides a secure and snug fit between the circuit board antenna 10 within the open slot. The adhesive foam 52 should create pressure between the sides of the pen slot and the circuit board antenna 10 to prevent the circuit board antenna from sliding or moving within the pen slot 13 and to maintain electrical continuity (or stable grounding) between 44 and the selected metalized plating 100 of the portable computer terminal 12.

Referring to FIGS. 5 and 6, a cable connector 54 for providing the connection between the data transmission cable 45 and the antenna 42 is shown. The extension leads 62 of the cable connector 54 are extended or placed through openings 64 of the circuit board 40. The extension leads 62 are extended to the antenna 42 to provide the antenna connections 43 (as illustrated in FIG. 4). The cable connector 54 is a Suhner/MCX type connector which is generally used for connecting coaxial cable and is known to those skilled in the art.

Figure 7:
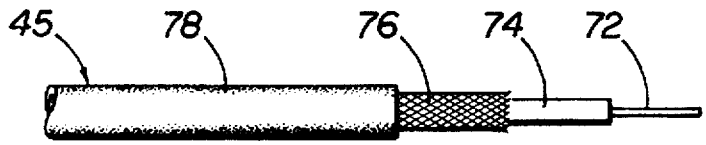
FIG. 7 shows a data transmission cable used with the present invention.
Figure 8:
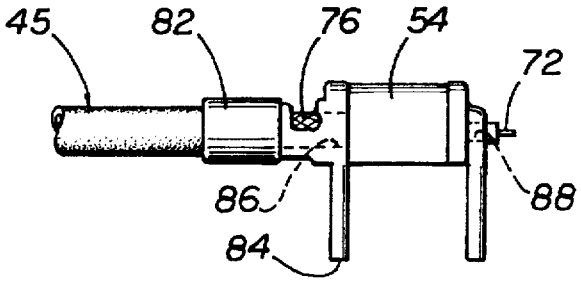
FIG. 8 shows a cable connector for connecting the data transmission cable to the circuit board antenna.

Referring to FIG. 7, the data transmission cable 45 is shown in more detail. The cable 45 has an inner conductor 72, a dielectric layer 74, a braided layer 76 and an outer insulating layer 78. The data transmission cable 45 is inserted into a collar 82 of the cable connector 54. The cable connector 54 has a pathway defined therethrough for receiving the data transmission cable 45 which enables the appropriate electrical connection to be made between the connection cable 45 and the antenna 42 as discussed above. The data transmission cable 45 should be stripped to expose the inner conductor 72 and the braided layer 76. The inner conductor 72 should extend beyond the braided layer 76 to enable the cable to be soldered to the cable connector 54 as discussed below. Data transmission cable 45 is pushed into the cable connector 54 to the positive stop 84 of the cable connector 54. The cable 45 should be un-sleeved (stripped) such that the braided portion 76 is exposed through the opening 86 of the connector 54. Additionally, the inner conductor 72 should be sufficiently exposed so that the inner conductor 72 may extend through the opening 88 of the cable connector 54. Once the cable is appropriately positioned within the cable connector 54, the braided portion of the data transmission cable 45 should be soldered to the body of the cable connector 54 at the opening 86. The soldering iron should be quickly removed when soldering in order to avoid melting the dielectric cable. After the braided portion has been appropriately soldered to the cable connector 54, the inner conductor 72 should be soldered to the cable connector 54 at the opening 88 to complete the connection of the conductor cable 45 with the cable connector 54.

Figure 9:
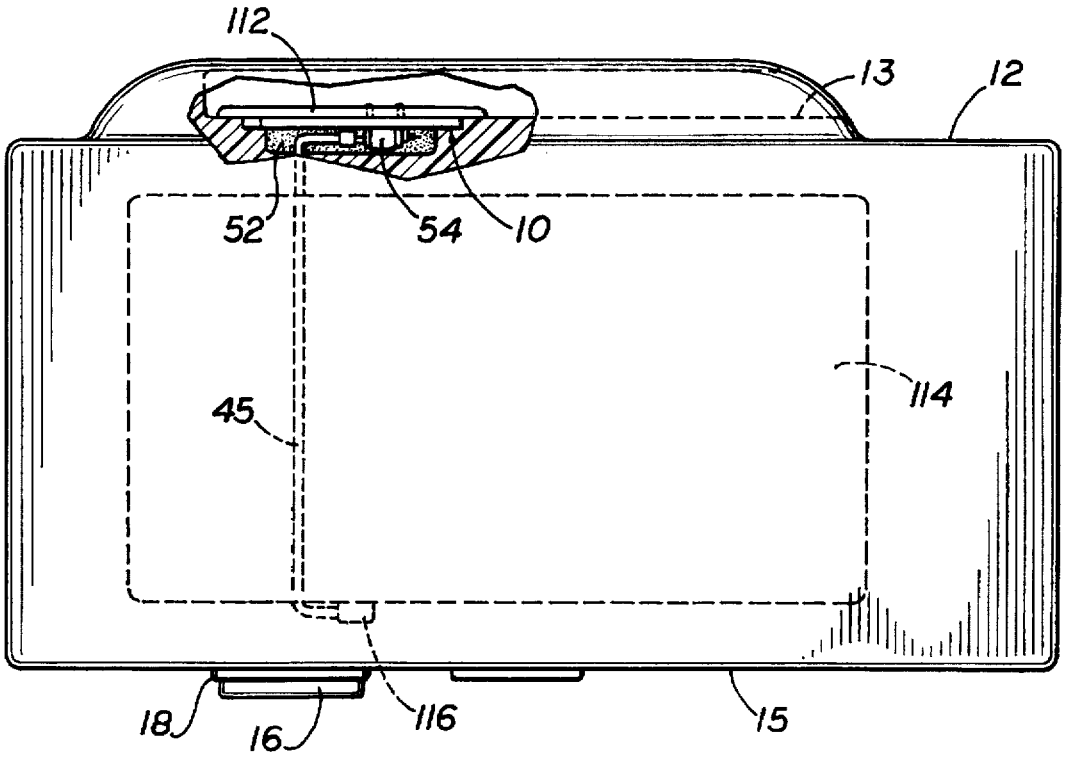
FIG. 9 shows a view of the portable computer terminal taken along line 9—9 of FIG. 1B.

Referring to FIG. 9, a view of the portable computer terminal 12 taken along line 9—9 is shown. FIG. 9 shows a top view of the circuitry of the portable computer terminal 12. The block 114 is an integrated circuit board that includes the circuit illustrated and discussed in connection with FIG. 2. As can be seen, the circuit board antenna 10 is positioned in the pen slot 13 against a raised plastic portion 112 of the pen slot 13. The adhesive foam 52 of the antenna circuit board 10 is pressed against a portion of the portable computer terminal 12 that creates a stabilizing pressure against the raised portion 112. The circuit board antenna 10 is thus snugly positioned in the pen slot 13 in a secure manner. Before the circuit board antenna 10 is securely positioned within the pen slot 13, the connecting cable 45 is passed under the circuit board 114 to connect to the rf connector 116 of the radio transmitter/receiver 16. By connecting the data transmission cable 45 as discussed and illustrated, a communication path for receiving and transmitting rf signals between the radio 16 of the portable computer terminal 112 and a computer system is provided.

The foregoing relates to the preferred embodiment of the present invention, and many changes may be made therein without departing from the scope of the invention as defined by the following claims.

We claim:

1. A radio receiver/transmitter communication system for a computer terminal including an expansion slot for receiving expansion circuit boards and an internal compartment defining an enclosure in the housing of said computer terminal, said internal compartment separated from said expansion slot by a portion of said terminal housing, comprising:

a stand-alone printed circuit board positioned within said enclosure of said internal compartment of said computer terminal;

a radio frequency communication medium etched on a first side of said stand-alone printed circuit board and operable within said enclosure of said computer terminal to support wireless communications;

a radio transmitter/receiver on a circuit board installed in said expansion slot; and a data transmission cable connected to and providing a data communication pathway between said radio frequency communication medium and said radio transmitter/receiver.

2. The system of claim 1 wherein said computer terminal is portable.

3. The system of claim 2 wherein said internal compartment comprises a stylus pen slot of said computer terminal.

4. The system of claim 3 wherein said radio frequency communication medium is the only etched medium on said printed circuit board.

5. The system of claim 4 wherein said radio frequency communication medium is etched on both a first selected portion of said printed circuit board and a second selected portion of said printed circuit board, said second selected portion in contact with a certain portion of said computer terminal housing to ground the second selected portion of the radio frequency communication medium.

6. The system of claim 5 wherein said first selected portion is not in contact with said computer terminal housing.

7. The system of claim 5 wherein said certain portion of said computer terminal housing is metalized plating.

8. The system of claim 1 further comprising a cable connector positioned on the side of said printed circuit board opposite said first side, said cable connector having conducting extensions extending through said printed circuit board to said first side of said printed circuit board and said conducting extensions being in contact with said radio frequency communication medium.

9. A stand-alone printed circuit board antenna for a wireless communications system including a portable computer terminal having an expansion slot for receiving a radio and an internal compartment defining an enclosure in the housing of said computer terminal, said internal compartment separated from said expansion slot by a portion of the computer terminal housing, comprising:

a printed circuit board installable within said enclosure of said internal compartment of said computer terminal; and a radio frequency communication medium etched on a first side of said printed circuit board and operable to support wireless communications when said printed circuit board is securely installed within said enclosure of said internal compartment of said computer terminal.

10. The antenna of claim 9 further comprising a cable connector positioned on the side of said printed circuit board opposite said first side, said cable connector having conducting extensions extending through said printed circuit board to said first side of said printed circuit board and said conducting extensions being in contact with said radio frequency communication medium.

11. A stand-alone antenna for use with a portable computer terminal having an expansion slot for receiving a radio and an internal compartment defining an enclosure in the housing of said computer terminal, said internal compartment separated from said expansion slot by a portion of said housing of said computer terminal, comprising:

a printed circuit board installable within said enclosure of said internal compartment;

a radio frequency communication medium etched on a first side of said printed circuit board and operative for receiving or transmitting radio frequency signals when said printed circuit board is mounted within said enclosure of said internal compartment; and a cable connector for connecting said radio frequency communication medium to said radio, said cable connector positioned on a second side of said printed circuit board opposite said first side and having conducting extensions extending through said printed circuit board to said first side of said printed circuit board, said conducting extensions being in contact with said radio frequency communication medium.

12. A wireless communications terminal, comprising:

a computer terminal comprising an expansion slot and an internal compartment defining an enclosure, the expansion slot located within a first portion of the computer terminal and the internal compartment located within a second portion of the computer terminal, the first terminal portion separated from the second terminal portion by a metalized plating extending along a portion of housing for the computer terminal;

a radio frequency communication medium etched on a first side of a printed circuit board and securely installed within said enclosure of said internal compartment;

a circuit board including a system for processing radio frequency signals and installed in said expansion slot of said computer terminal; and a cable connector comprising a cable extending between the first and second terminal portions to communicate radio frequency signals between said radio and said radio frequency communication medium, said radio frequency communication medium operable to support wireless communications by said radio while positioned within said enclosure of said internal compartment.

13. The wireless communications terminal of claim 12 wherein said computer terminal is portable and said internal compartment comprises a slot useful for holding a stylus pen for the computer terminal.

14. The wireless communications terminal of claim 13, wherein said cable connector further comprises a connector positioned on a second side of said printed circuit board opposite said first side and includes conducting extensions extending through said printed circuit board to said first side of said printed circuit board, said conducting extensions being in contact with said radio frequency communication medium.

15. The wireless communications terminal of claim 13 wherein said radio frequency communication medium is operable to support wireless communications from a fixed position within said stylus pen slot, and wherein said printed circuit board is secured within said stylus pen slot by adhesive foam.

16. The wireless communications terminal of claim 15 wherein said radio frequency communication medium is etched on both a first selected portion of said printed circuit board and a second selected portion of said printed circuit board, said second selected portion in contact with a certain portion of said computer terminal housing to ground said second selected portion of the radio frequency communication medium.

17. The wireless communications terminal of claim 16 wherein said certain portion of said computer terminal housing comprises said metalized plating separating said first terminal portion from said second terminal portion.

18. The wireless communications terminal of claim 17 wherein said first selected portion of said printed circuit board is positioned within said stylus pen slot without contacting a surface of said stylus pen slot.

* * * * *